United States Patent [19]

Portis, Jr. et al.

[11] 4,378,102

[45] Mar. 29, 1983

[54] BOOK OR MAGAZINE READING SUPPORT

[76] Inventors: Leroy Portis, Jr., 9244 S. Bishop, Chicago, Ill. 60620; Kenneth C. Neal, 2144 W. 71 Pl., Chicago, Ill. 60636

[21] Appl. No.: 211,131

[22] Filed: Nov. 28, 1980

[51] Int. Cl.[3] ..... A47B 19/00

[52] U.S. Cl. ..... 248/460; 248/165; 248/451

[58] Field of Search ..... 248/441 A, 451, 460, 248/461, 473, 469, 165, 174

[56] References Cited

U.S. PATENT DOCUMENTS

| | | | |
|---|---|---|---|
| 1,041,277 | 10/1912 | Hawley | 248/441 A |
| 1,117,386 | 11/1914 | Hughes . | |
| 1,601,997 | 10/1926 | Coss et al. . | |
| 1,763,748 | 6/1930 | Best | 248/165 X |
| 1,947,053 | 2/1934 | Mason | 45/57 |
| 2,551,071 | 5/1951 | Tyng | 248/165 UX |
| 2,579,740 | 12/1951 | Hiemenz | 45/80 |
| 2,807,908 | 10/1957 | Lykes | 248/451 |
| 2,840,331 | 6/1958 | Clifton | 248/165 X |
| 3,001,750 | 9/1961 | Hedlund | 248/165 |
| 3,147,948 | 9/1964 | Evanoff | 248/455 |
| 3,381,928 | 5/1968 | White | 248/455 |
| 3,476,348 | 11/1969 | Rustad | 248/455 |
| 3,762,675 | 10/1973 | Sankey | 248/464 |
| 4,150,807 | 4/1979 | Manso | 248/452 |

FOREIGN PATENT DOCUMENTS

| | | | |
|---|---|---|---|
| 1518012 | 2/1968 | France | 248/441 A |
| 768 | of 1886 | United Kingdom | 248/451 |
| 525298 | 8/1940 | United Kingdom | 248/451 |

*Primary Examiner*—J. Franklin Foss

*Attorney, Agent, or Firm*—McCaleb, Lucas & Brugman

[57] ABSTRACT

A book or magazine reading support including a rectangular back board with a forwardly extending shelf along the lower margin, and a pair of V-shaped brackets each having a long and a short arm diverging at an acute angle relative to one another. Each bracket has an open slot at the end of each arm. The reading support is optionally assembleable in high or low modes by interconnecting the slots of the long arms or the short arms respectively with the slots of the back board. A thin, clear monofilament line with weights at opposite ends is fastened at the rear of the back board and extends upwardly over the top edge of the back board and downwardly across an opened book or magazine on the front surface of the back board, through a pair of grooves in the shelf. The weights tension the line and hold the pages open.

5 Claims, 5 Drawing Figures

BOOK OR MAGAZINE READING SUPPORT

BACKGROUND OF THE INVENTION

This invention relates generally to book or magazine reading supports. More specifically, it relates to such a support having a back board supported on a pair of upstanding brackets which hold the back board at a comfortable reading angle.

It is well-known to those skilled in this particular field that book or magazine reading supports are available in a variety of forms for reading on a desk or table top, in a chair, or in bed, without constant attention on the part of the reader to hold the pages open. However, most of these are relatively complicated, comprise a variety of parts, some being small and easily lost, and having relatively complicated adjusting means. Representative examples of this prior art are shown in the following patents: Hughes U.S. Pat. No. 1,117,386 on "Book Rest"; Coss et al U.S. Pat. No. 1,601,997 on "Bed Attachment"; Mason U.S. Pat. No. 1,947,053 on "Book Holder"; Hiemenz U.S. Pat. No. 2,579,740 on "Convertible Folding Reading Stand"; Evanoff U.S. Pat. No. 3,147,948 on "Adjustable Book Holding Means"; White U.S. Pat. No. 3,381,928 on "Book Rest Or The Like"; Rustad U.S. Pat. No. 3,476,348 on "Book Rest"; Sankey U.S. Pat. No. 3,762,675 on "Cook Book Stand Construction"; and Manso U.S. Pat. No. 4,150,807 on "Book Holding Device". This situation is accordingly in need of improvement.

SUMMARY OF THE INVENTION

Therefore a principal object of the present invention is to provide a book or magazine reading support that comprises a minimum number of basic components, namely, a back board and a pair of V-shaped brackets, these components being assembled for use by interlocking slots, and readily disassembleable for compact storage.

Another object is to provide such a reading support in which ends of the shelf abut the brackets to stabilize the support in assembled reading position.

Another object is to provide such a reading support having page-holding means consisting of a flexible line with weights at opposite ends extending downwardly along the front surface of the back board to hold reading material open on the board by the weight-induced tension in the line.

Another object is to provide such a reading support in which the tensioned line is a thin, clear monofilament which will not obscure reading material under it.

Another object is to provide such a reading support which is readily convertible from high mode to low mode, and vice versa, by reversing the positions of the V-shaped brackets.

Another object is to provide such a reading support in which each V-shaped bracket has long and short arm disposed at an acute angle relative to one another, each bracket having an open slot at the end of each arm, the reading support being optionally assembleable in high or low modes by interconnecting the slots of the long arms or the short arms, respectively, with slots in the back board.

BRIEF DESCRIPTION OF THE DRAWINGS

Other objects and advantages will be apparent from the following description taken in connection with the accompanying drawings in which.

Like parts are referred to by like reference characters.

DESCRIPTION OF THE PREFERRED EMBODIMENT

Figure 1:
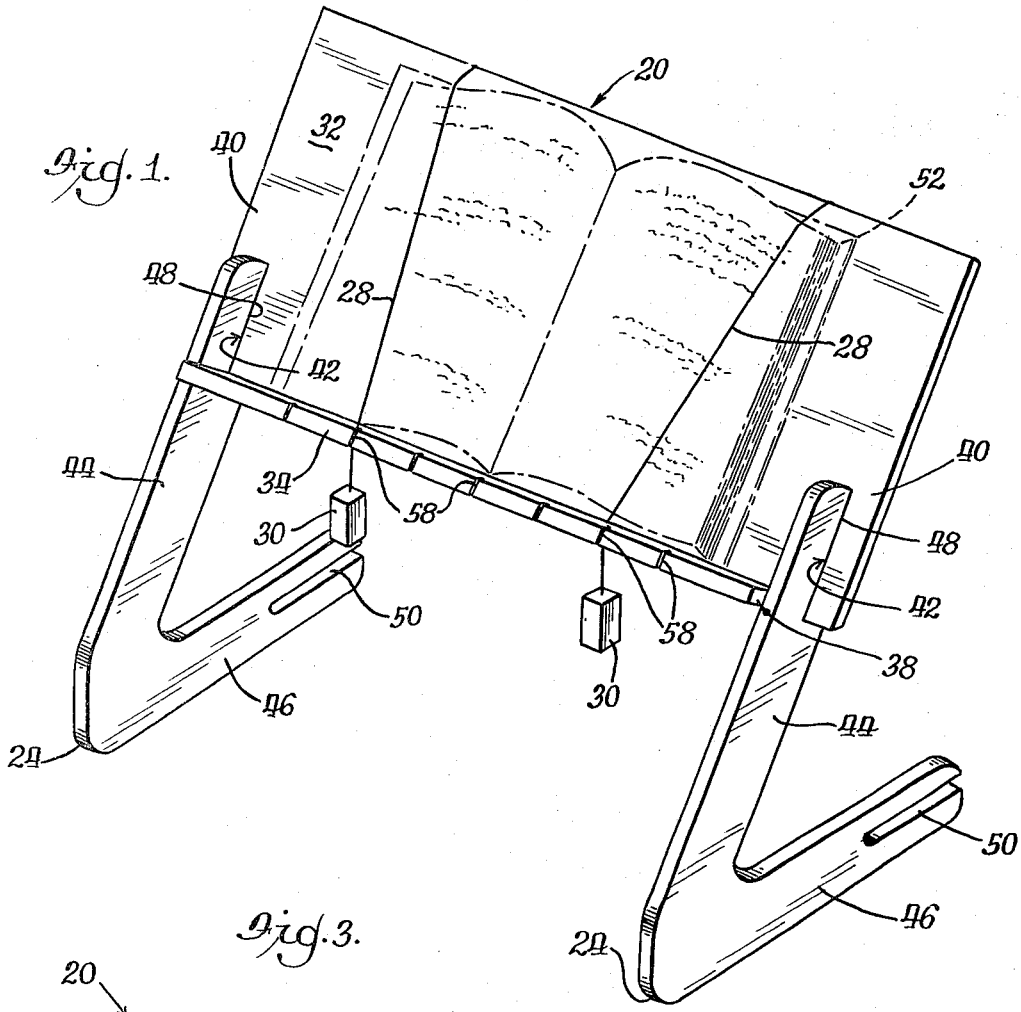
FIG. 1 is an upright, perspective view of a book or magazine reading support illustrating a preferred form of the present invention.

Referring now to the specific embodiment of the invention shown in the drawings, the reading support is generally designated 20. Major components include a back board 22 and a pair of V-shaped brackets 24, 24. In addition, page-holding means 26 is here illustrated as a flexible line 28 with weights 30, 30 affixed to its ends.

The back board 22 comprises a rectangular panel 32 of any suitable decorative material, for example, fiberboard or particle board. A forwardly projecting shelf is fastened in a center positon along the lower marginal edge 36. The length of the shelf (sidewise of the reading support) is less than the length of the lower marginal edge 36, so the shelf ends 38, 38 terminate short of the back board side edge portions 40, 40. Substantially vertical, parallel slots 42, 42 extend upwardly from the lower marginal edge 36.

The V-shaped brackets 24, 24 are identical. They are made of flat material such as fiberboard or particle board suitably decoratively finished. Each comprises a long arm 44 and a short arm 46 with open slots 48 and 50 at their respective ends. In the example shown, the arms 44 and 46 diverge at approximately 60°, to provide a comfortable reading angle.

FIGS. 1–4 show the reading support with these components assembled in high mode with back board 22 supported at the top ends of long arms 44, 44, and short arms 46, 46 providing a horizontal base to hold the device on a suitable horizontal surface such as a chair or sofa seat, a bed, or a desk or counter top. In this high mode long arm slots 48, 48 engage slots 42, 42 in the back board.

Figure 5:
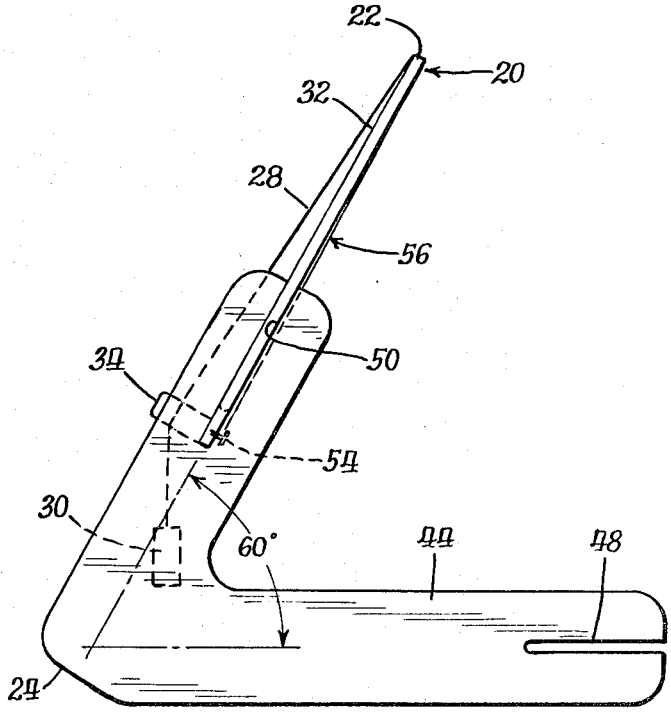
FIG. 5 is a side view, similar to FIG. 2, with the support brackets reversed to change the support from high mode to low mode.

Alternatively, the V-shaped brackets 24, 24 may be assembled in a low mode position show in FIG. 5, where slots 50, 50 of short arms 46, 46 interlockably engage the back board slots 42, 42. In this mode, the long arms 44 provide a base for resting the reading support on a chair, sofa, bed, counter or desk.

The line 28 comprises preferably a thin, clear, monofilament of nylon or the like having great strength but of insufficient width to obscure reading material on a book or magazine 52 shown in broken lines in FIG. 1. The weights 30, 30 may, for example, comprise lead cores for weight, within decorative wood or plastic shells which also prevent user contact with the lead core material.

Figure 3:
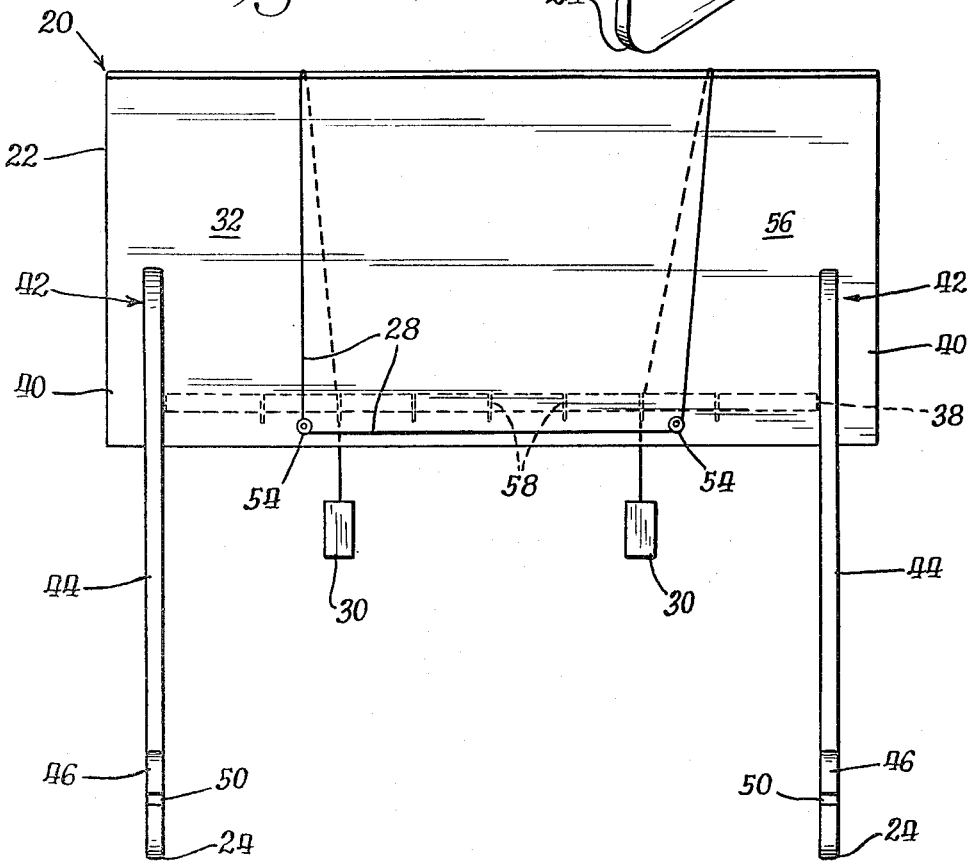
FIG. 3 is a rear view of FIG. 1.
Figure 4:
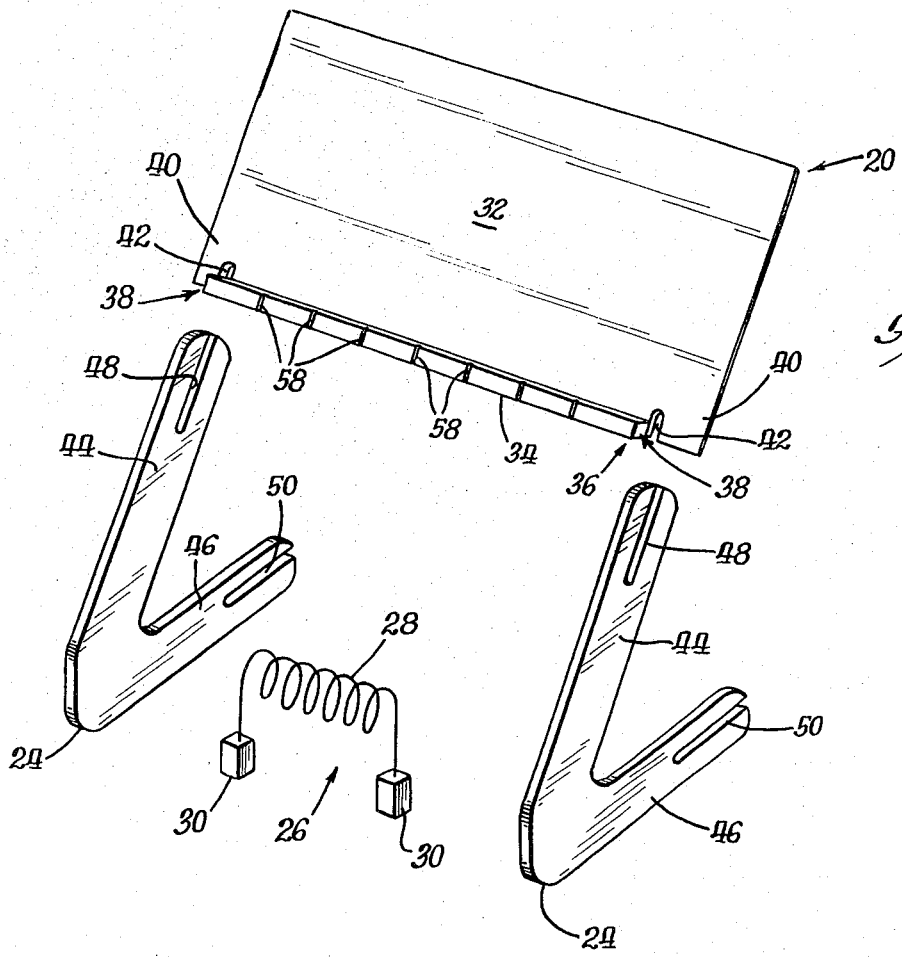
FIG. 4 is an exploded, perspective view of FIG. 4.
Figure 2:
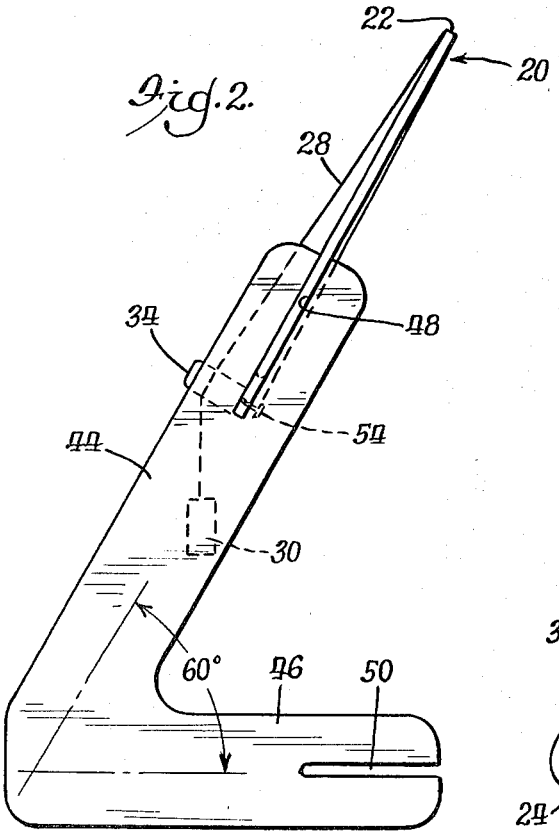
FIG. 2 is a side view of FIG. 1.

As shown of FIG. 3, the line 28 is trained about a pair of tacks or nails 54, upwardly along the rear surface 56, then (as shown in FIG. 1) downwardly across the book or magazine 52 on the front face of panel 32, and through a suitable pair of vertical grooves 58 in the front edge of the shelf 34. A plurality of these grooves 58 are provided to adapt the reading support to different widths of books and magazines. The weights 30, 30 hang below the shelf 34 to hold the pages open by applying a gentle tension to the line 28.

Use of the reading support is believed to be obvious. Briefly, however, the brackets 46, 46 will be assembled in the high mode (FIGS. 1–4) or in the low mode (FIG. 5) according to the user's elevation requirements. The book or magazine 52 will be placed on the back board panel 32 and shelf 34 and both end portions of the line 28 will be trained across open pages as shown in FIG. 1. The user can then easily read the copy without holding the pages open manually. Without limitation thereto, applications includes reading in bed, reading in a chair, supporting a recipe book on a kitchen counter, drawing or sketching in a chair or bed, and use as a table top lectern.

While certain novel features of this invention have been shown and described and/or pointed out in the annex claims, it will be understood that various omissions, substitutions and changes in the forms and details of the device illustrated can be made by those skilled in the art without departing from the spirit and scope of the invention.

The embodiments of the invention in which an exclusive property or privilege is claimed are defined as follows:

1. A book or magazine support comprising:

a back board consisting of a flat, rectangular member with a forwardly projecting shelf along the lower margin thereof and terminating short of the side edge portions of the back board, said side edge portions having open-ended parallel slots extending upwardly from the lower edge thereof adjacent the ends of the shelf;

a pair of V-shaped brackets each having a pair of opposite arms diverging at an acute angle relative to one another, said arms having open slots at the ends thereof; and said brackets being temporarily assembleable beneath the back board by engaging a slot in one of the arms of each bracket with one of the slots in the side edge portions of the back board while resting the opposite arm of each bracket on a horizontal surface to hold the back board at an inclination comfortable for reading as determined by the acute angles of the brackets.

2. A reading support according to claim 1 in which the ends of the shelf abut the brackets to stabilize the support in reading position.

3. A reading support according to claim 1 having page-holding means consisting of a flexible substantially non-elastic line with weights at opposite ends, a plurality of pairs of line-holding grooves in the front edge of said shelf, means at the rear of the back board to engage and hold an intermediate portion of said line, and the end portions of said line extending upwardly over the top edge of the back board and downwardly along the front surface of the back board end engaged within a pair of said grooves in the shelf to hold reading material open on the board by the tension in the line produced by said weights.

4. A reading support according to claim 3 in which the line is a thin, clear monofilament whereby it will not obscure reading material under it.

5. A book or magazine reading support comprising:

a back board consisting of a flat, rectangular member with a forwardly projecting shelf along the lower margin thereof and terminating short of the side edge portions of the back board, said side edge portions having parallel slots extending upwardly from the lower edge thereof;

a pair of V-shaped brackets each having opposite long and a short arms disposed at an acute angle relative to one another, each bracket having an open slot at the end of each arm thereof; and said reading support being optionally assembleable in high or low modes by interconnecting the slots of the long arms or the short arms respectively with the slots of the back board.

* * * * *